US008887467B2

(12) United States Patent
Underkofler et al.

(10) Patent No.: US 8,887,467 B2
(45) Date of Patent: Nov. 18, 2014

(54) CEILING PANEL WIRE ANCHOR

(71) Applicant: USG Interiors, LLC, Chicago, IL (US)

(72) Inventors: Abraham M. Underkofler, Waukegan, IL (US); Peder J. Gulbrandsen, Aurora, IL (US); Mark R. Paulsen, Beach Park, IL (US)

(73) Assignee: USG Interiors, LLC, Chicago, IL (US)

( * ) Notice: Subject to any disclaimer, the term of this patent is extended or adjusted under 35 U.S.C. 154(b) by 0 days.

(21) Appl. No.: 13/865,424

(22) Filed: Apr. 18, 2013

(65) Prior Publication Data

US 2014/0311078 A1 Oct. 23, 2014

(51) Int. Cl.
*E04B 9/00* (2006.01)
*E04B 9/18* (2006.01)

(52) U.S. Cl.
CPC ..... *E04B 9/18* (2013.01)
USPC ..... 52/506.07; 52/506.05; 248/342

(58) Field of Classification Search
CPC ..... E04B 9/00; E04B 2009/00
USPC ..... 52/506.05–506.1, 361, 362, 39, 511; 24/295, 612; 248/686, 342; 411/340, 411/344
See application file for complete search history.

(56) References Cited

U.S. PATENT DOCUMENTS

| | | | | | |
|---|---|---|---|---|---|
| 2,740,179 | A * | 4/1956 | Flora | 24/618 |
| 3,246,375 | A * | 4/1966 | Landwer | 24/297 |
| 3,266,202 | A * | 8/1966 | Furer | 52/39 |
| 3,612,461 | A * | 10/1971 | Brown | 248/317 |
| 4,025,019 | A * | 5/1977 | Jacobsen et al. | 248/317 |
| 4,112,815 | A * | 9/1978 | Tanaka | 411/512 |
| 4,230,297 | A * | 10/1980 | Comer et al. | 248/317 |
| 5,228,816 | A * | 7/1993 | Boville | 411/340 |
| 6,524,044 | B1 * | 2/2003 | Vassiliou | 411/55 |
| 7,014,408 | B2 * | 3/2006 | O'Banion et al. | 411/448 |

* cited by examiner

*Primary Examiner* — Jeanette E Chapman
*Assistant Examiner* — Daniel Kenny
(74) *Attorney, Agent, or Firm* — Pearne & Gordon LLP

(57) ABSTRACT

A sheet metal fastener and method of use with a low density porous ceiling panel, the fastener comprising a plurality of blades adapted to be manually driven into a backside of a low density fibrous ceiling panel core, each blade being arranged to be pivoted about a horizontal axis in a direction opposite another one of the blades while embedded in the core to fix the fastener to the panel and an upstanding structure attached to said blades adapted to project upwardly from a rear side of the panel and having an aperture for receiving a suspension wire.

7 Claims, 4 Drawing Sheets

FIG. 1
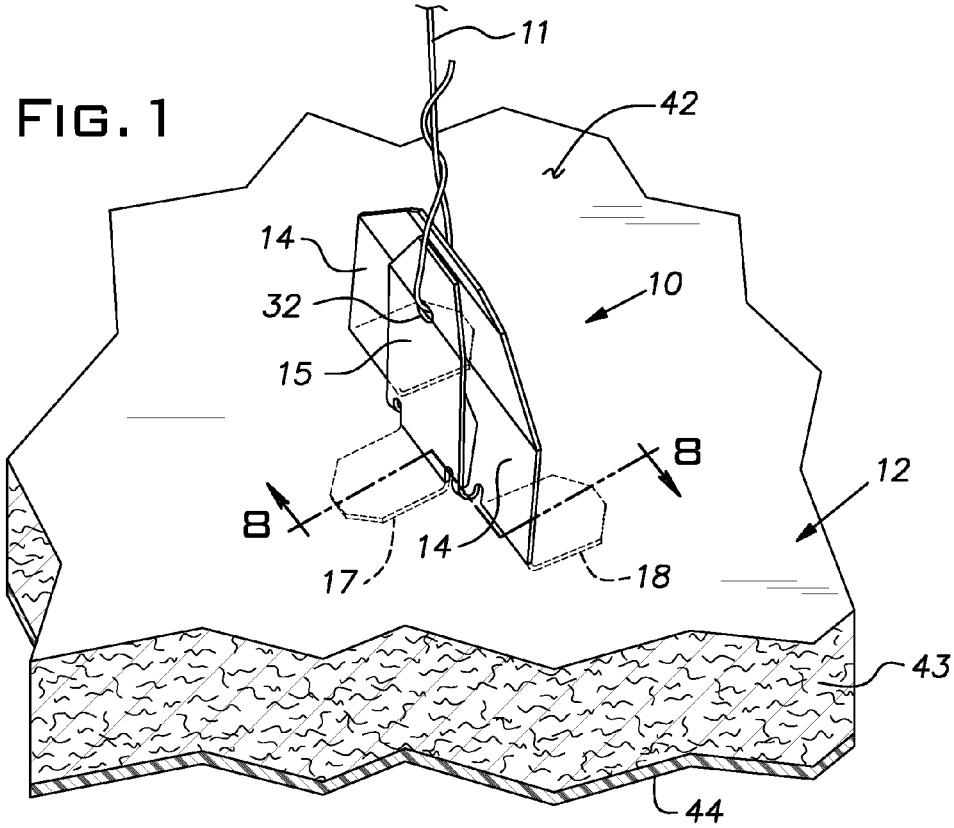
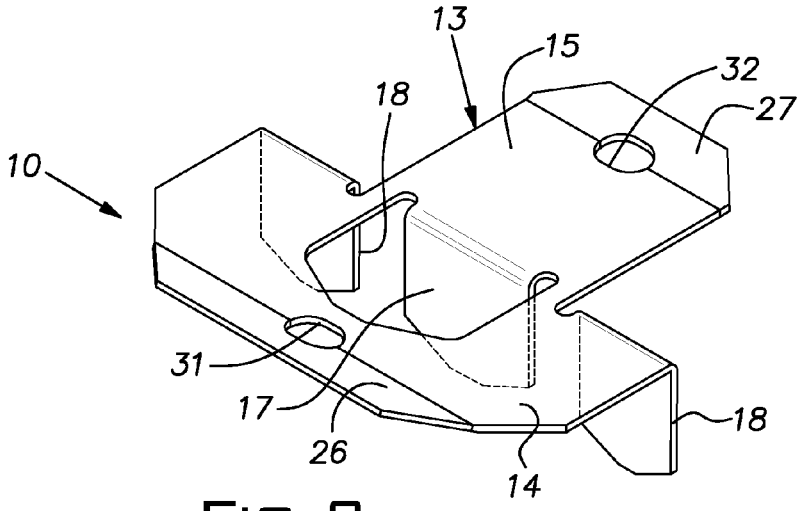
FIG. 2

CEILING PANEL WIRE ANCHOR

BACKGROUND OF THE INVENTION

The invention relates to an anchor clip or fastener for attaching suspension wires or the like directly to an acoustical ceiling panel.

PRIOR ART

Suspended ceilings are used extensively in commercial buildings. Typically, the suspended ceilings comprise a rectangular grid and panels lying across the grid spaces. The grid elements are suspended from superstructure above the plane of the ceiling. Important attributes of suspended ceilings include the creation of a space or plenum above the plane of the ceiling. Utilities can exist in the plenum and ready accessibility is afforded to the plenum for service, repair, alteration and additions to the utilities, for example. Typically, the grid is suspended by wires that extend downwardly from the overlying superstructure such as bar joists, I-beams and/or a floor or roof deck. Usually, suspended ceilings are provided with acoustical panels which serve to diminish noise in an occupied space below the ceiling.

Architects and interior designers are regularly charged with the task or have a personal desire to develop ceiling arrangements that depart from the ubiquitous ceiling panel and grid look. For example, designers may want to avoid the look of the typical ceiling grid and traditional sizes and shapes of the ceiling panels, but still want to provide accessibility and noise reduction.

SUMMARY OF THE INVENTION

The invention provides a method and arrangement for suspending ceiling panels without the need of a supporting grid. The panels, according to the invention, are attached to suspension wires or other support elements with "blind" fasteners secured to the panels at their rear faces. The fasteners are blind in the sense that they do not penetrate the visible face of the panel.

The disclosed fastener is a stamped sheet metal anchor clip. The fastener is embedded in the body or core of the ceiling panel with an area, projected in horizontal plane, that is sufficiently large to assure that a retention force substantially greater than the portion of the weight of the panel associated with the fastener is developed.

The clip is configured to work as a type of plier where finger grips, analogous to plier handles, are drawn together and a pair of blades, analogous to plier jaws, open up and spread apart. The fastener is a unitary or monolithic body having "living hinge" elements that form pivot points for relative movement between the finger grips and between the blades.

The fastener is manually installed on the rear side of a ceiling panel by plunging a set of opposed blades vertically into the panel core. When the length of the blades is fully received in the core, the finger grips are pivoted from an original horizontal orientation to an upstanding generally vertical orientation. The blades are simultaneously spread into a generally horizontal orientation. The finger grips include a hole for receiving a suspension wire or the like. A plurality of fasteners is used to suspend a single panel. Preferably, the fasteners are spaced inwardly from the edges of a panel to minimize the visibility of the suspension elements.

BRIEF DESCRIPTION OF THE DRAWINGS

FIG. 1 is a fragmentary isometric view of a ceiling panel suspended with the fastener of the invention in an installed configuration;

FIG. 2 is an isometric view of the inventive fastener in an initial configuration;

DESCRIPTION OF THE PREFERRED EMBODIMENT

Figure 5:
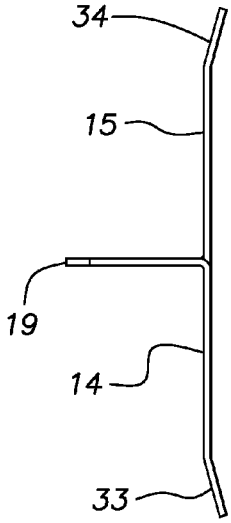
FIG. 5 is an edge view of the inventive fastener.
Figure 3:
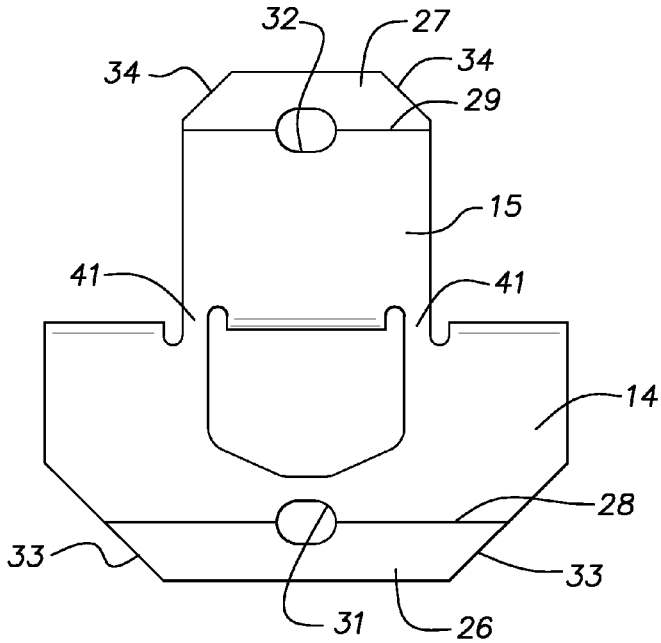
FIG. 3 is a plan view of the inventive fastener.
Figure 4:
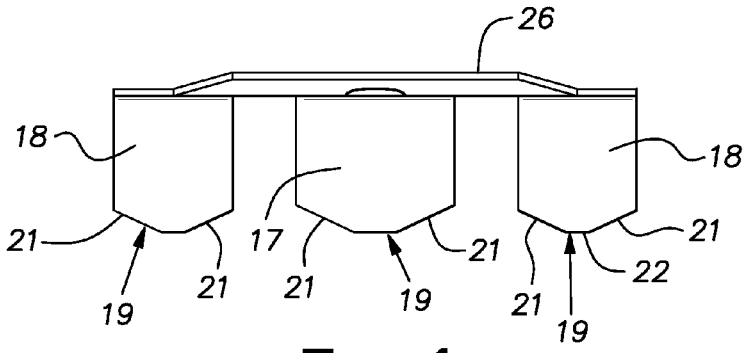
FIG. 4 is a side view of the inventive fastener.

The various figures illustrate a clip anchor or fastener 10 for coupling a suspension element such as a wire 10 directly to a ceiling panel, preferably an acoustical ceiling panel 12. The fastener 10, with other identical fasteners, permits the construction of a suspended ceiling of multiple panels without a conventional rectangular metal grid supporting the edges of the panels.

The fastener 10 is preferably made of sheet metal, for example hot dipped, galvanized steel of 0.036 inch thickness. The fastener 10 is stamped into the configuration illustrated in FIGS. 2-7. With particular reference to FIGS. 2-5, the fastener 10 has a planar mid-part 13 comprising a major section 14 and a minor section 15. The fastener includes a set of blades or jaws 17, 18 depending perpendicularly from the plane of the mid-part 13. It will be seen that two of the blades 18 are formed of sheet stock material that originally lay alongside the minor section 15. A central blade 17 is cut from an area of the sheet stock lying between outlying portions of the major section 14. Distal edges 19 of each of the blades 17, 18 are shaped with laterally outwardly, upward inclined portions 21 and a short central horizontal portion 22.

Outlying zones of the planar sections 14, 15 have associated tabs 26, 27 from bent up from the plane of these sections at lines 28, 29. A hole, 32, is punched in respective sections 14, 15. The perimeters of the tabs 26, 27 and portions of the major section 14 are trimmed at their respective corners 33, 34 to avoid sharp points of 90 degree edge intersections.

The blades 17, 18 initially as manufactured lie in a common plane perpendicular to the planar mid-part 13. As most clearly shown in FIG. 3, the major and minor sections 14, 15 are joined by relatively small webs 41 that bridge across the plane of the blades 17, 18.

Figure 6:
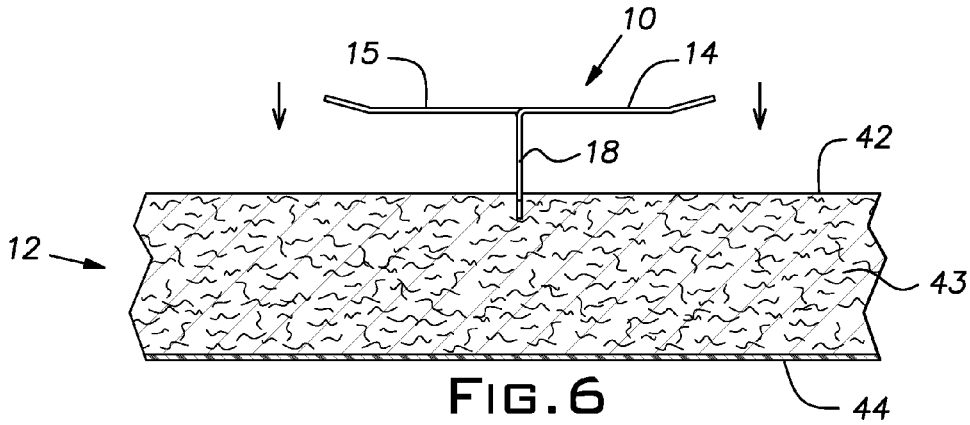
FIG. 6 is a diagrammatic representation of an initial stage of the assembly of the fastener and a ceiling panel.
Figure 7:
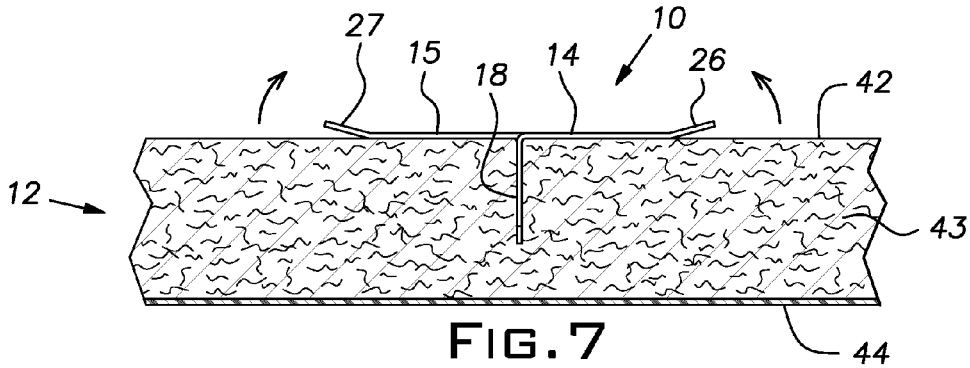
FIG. 7 is a diagrammatic representation of an intermediate stage of the assembly of the fastener and ceiling panel.
Figure 8:
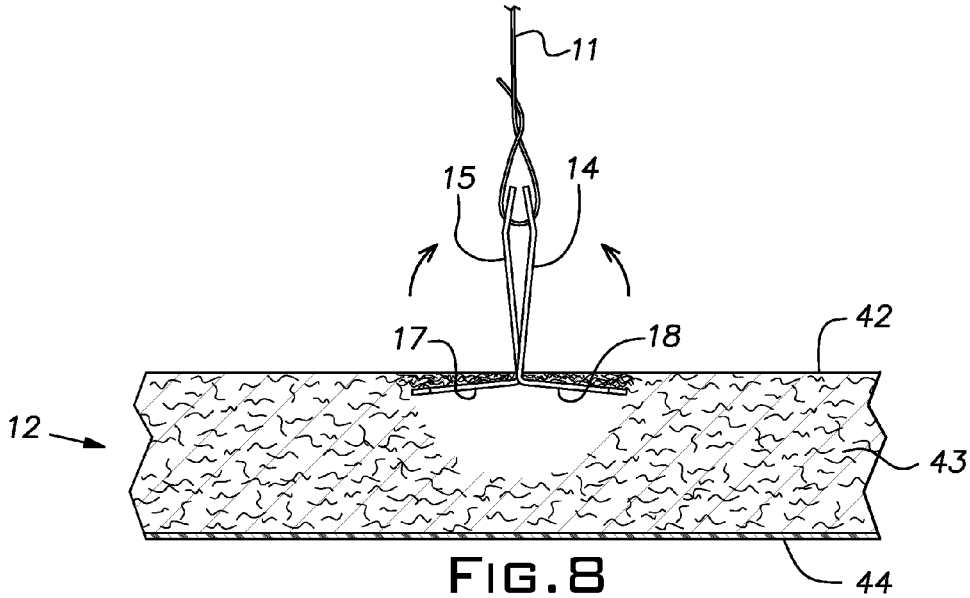
FIG. 8, taken along the staggered vertical plane 8-8 in FIG. 1, is a diagrammatic representation of a final stage of the assembly of the fastener and ceiling panel.

The fastener 10 is used, ideally, with commercially known ceiling panels 12 having a core made of porous fibrous material such as non-woven glass fiber bonded together with a suitable resin. The panel 12 can be, for example, 1 to 1⅛ inch thick or thicker and can have a weight of about ½ pound per square foot. It is expected that a fastener 10 will be installed on a panel at the site where the panel is to be used in a suspended ceiling installation. FIGS. 6-8 illustrate the manner in which the fastener 10 is installed on a panel 12. A location on the back or reverse side 42 of a ceiling panel 12 corresponding to the location of a suspension element is determined. Ordinarily, the fasteners 10 are located inwardly from the peripheral edges of the panel 12 so that the suspension elements, typically the wires, are not visible or are inconspicuous. The technician installing the suspended ceiling or a helper manually presses the fastener 10, with the blades 17, 18 oriented downwardly, into the panel 12 from the backside at the pre-determined location. This step is depicted in FIG. 6. The fastener 10 is pressed into the panel core until, as shown in FIG. 7, the planar mid-part 13 abuts the rear side 42 of the panel 12. At this position, the blades 17, 18 are fully extended into the panel core, designated 43. The length of the blades 17, 18 is less than the thickness of the panel 12 so that there is no risk in normal circumstances that the blades 17, 18 will penetrate a front face 44 of the panel.

The core 43, as mentioned, is preferably porous while having adequate structural integrity and stiffness to support itself across an expected span. The blades 17, 18 are capable of severing through the fibrous matte of the core 43. Once the planar mid-portion 13 of the fastener 10 has been driven against the rear side 42 of the panel, the major and minor sections 14, 15 are manually bent upwardly as suggested in FIGS. 7 and 8. The sections 14, 15 are bent upwardly by getting a fingertip hold on the tabs 26, 27 and prying up the respective sections. The sections 14, 15 are manually squeezed towards one another until the tabs 26, 27 abut or nearly abut. The sections 14, 15, during this pivotal movement serve in a manner analogous to the handles of a pair of pliers. During the upward pivoting movement of the section 14, 15, the webs 41 act as hinge points or pivot centers for relative movement between the sections. The joint between each of the blades 17, 18 and the respective section 15, 14, is far stronger than that of the webs 41 as well as the compressive strength of the core 43. The right angle configuration of the blades 17, 18 to their respective sections 15, 14, remains as the sections are pivoted from horizontal orientations to generally vertical orientations. Material of the core 43 in the path swept by the blades 17, 18 as the blades pivot with their respective sections 15, 14, is compressed into a dense fibrous mass above the now deployed, pivoted blades 17, 18. The webs 41 are twisted beyond their yield point or elastic limit and hold the sections 14, 15 in their upright, generally vertical orientations once they are squeezed into this position. The holes 31, 32 are aligned with one another when the sections 14, 15 are squeezed together enabling a wire to be assembled through both holes. The various figures show a suspension wire, of the type typically used in suspended ceilings, assembled through the holes 31, 32 and twisted to lock the fastener 10 and the panel at an appropriate height. Suspension elements other than wires, such as hooks, can be used with the fasteners 10 in areas where limited clearance is available above the plane of a ceiling panel.

Figure 9:
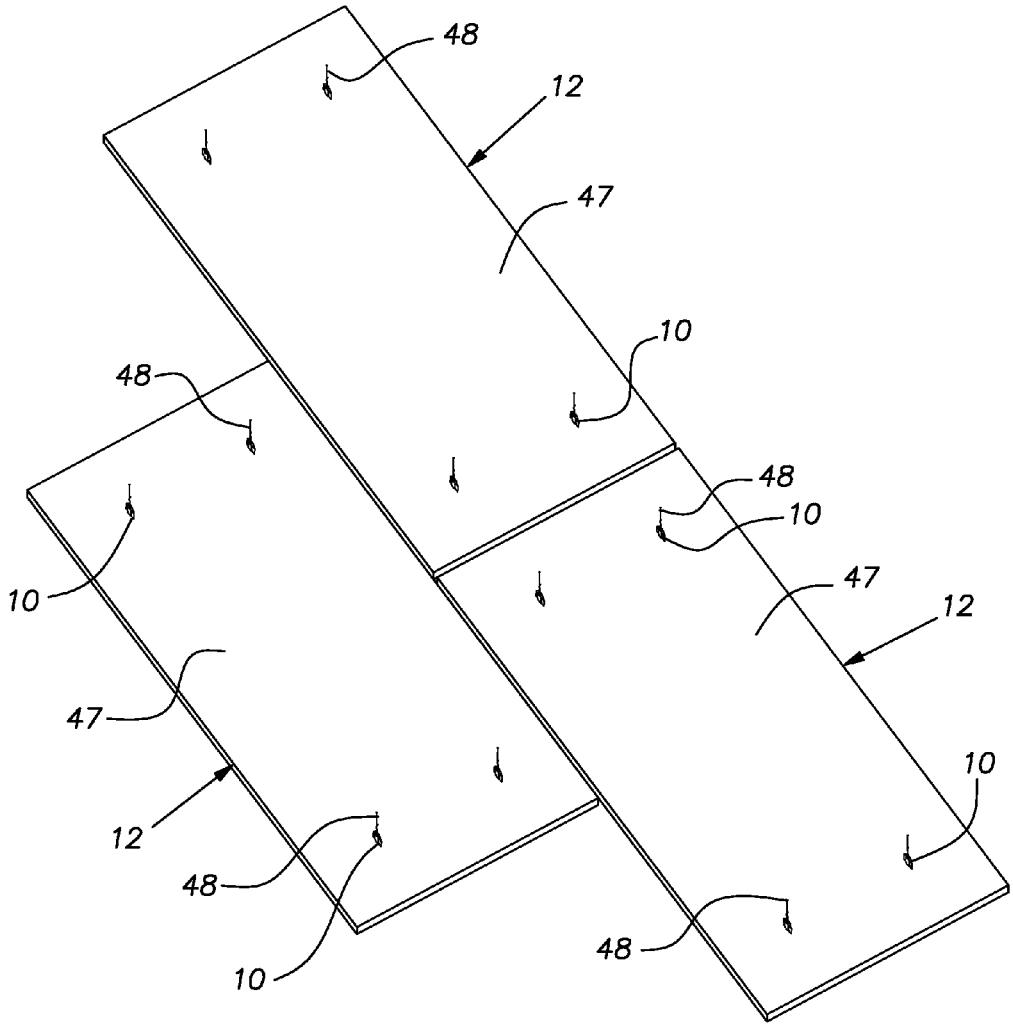
FIG. 9 is an isometric view, from above, of a representative suspended ceiling construction in accordance with the invention.

Ordinarily three or more fasteners 10 are assembled on a single ceiling panel 12. FIG. 9 represents one of a myriad of potential gridless suspended ceiling systems employing fasteners of the present invention. The system 46 includes a plurality of rectangular panels 47 of the type described above. Each panel 47 has a plurality of fasteners 10 attached to its rear upper face and each fastener is supported by a suspension wire 48. It will be understood that the panels 47 can be non-rectangular in shape and of a variety of shapes in a particular ceiling installation.

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

What is claimed is:

1. A sheet metal fastener for use with a low density porous ceiling panel comprising a plurality of blades each with a leading edge adapted to be manually driven into a backside of a low density fibrous ceiling panel core, each blade being arranged to be pivoted about a horizontal axis in a direction opposite another one of the blades so that the respective leading edges move away from one another while embedded in the core to fix the fastener to the panel and an upstanding structure attached to said blades adapted to project upwardly from a rear side of the panel and having an aperture for receiving a suspension wire.

2. A fastener as set forth in claim 1, wherein the structure adapted to project upwardly is rigidly attached to said blades.

3. A fastener as set forth in claim 2, wherein said structure is manually pivotable to effectuate pivoting of said blades.

4. A fastener as set forth in claim 3, wherein said structure comprises a pair of sections that extend in opposite directions relative to one another and are manually pivotable relative to one another to extend in generally the same direction, the sections being constructed and arranged to pivot said blades from common directions to substantially opposite directions.

5. A fastener as set forth in claim 4, wherein said sections are interconnected by relatively small webs adapted to serve as hinges to permit pivotal movement.

6. A fastener as set forth in claim 5, wherein each of said fastener sections has at least one of said blades rigidly attached thereto in a generally perpendicular relationship.

7. A fastener for direct suspension of a ceiling panel, the fastener being formed of a single monolithic piece of sheet metal, the fastener comprising first and second sections extending in generally opposite directions and being pivotally joined by hinge points, each of said sections having at least one rigidly attached associated blade projecting in a plane forming an angle with the respective section, the fastener being constructed and arranged to permit said blades to be stabbed into a porous fibrous core of the ceiling panel while they are generally parallel to each other and be splayed away from each other when said sections are manually drawn to each other in pivotal action about said hinge points.

* * * * *